US011168512B2

(12) United States Patent
Gerstein

(10) Patent No.: US 11,168,512 B2
(45) Date of Patent: Nov. 9, 2021

(54) WINDOW INSULATION APPARATUS AND METHOD

(71) Applicant: Thermwell Products Co., Inc., Mahwah, NJ (US)

(72) Inventor: James Gerstein, Mahwah, NJ (US)

(73) Assignee: THERMWELL PRODUCTS CO., INC., Mahwah, NJ (US)

( * ) Notice: Subject to any disclaimer, the term of this patent is extended or adjusted under 35 U.S.C. 154(b) by 0 days.

(21) Appl. No.: 16/387,888

(22) Filed: Apr. 18, 2019

(65) Prior Publication Data

US 2020/0011114 A1 Jan. 9, 2020

Related U.S. Application Data

(60) Provisional application No. 62/659,372, filed on Apr. 18, 2018.

(51) Int. Cl.

| | |
|---|---|
| ***B65H 35/04*** | (2006.01) |
| ***E06B 3/28*** | (2006.01) |
| ***E04B 1/78*** | (2006.01) |
| ***B65D 83/08*** | (2006.01) |

(52) U.S. Cl.

CPC ..... *E06B 3/285* (2013.01); *B65D 83/0841* (2013.01); *B65H 35/04* (2013.01); *E04B 1/78* (2013.01); *B65H 2301/51512* (2013.01)

(58) Field of Classification Search

CPC ... E06B 3/285; B65H 35/0026–35/004; B65H 2301/51512; B26D 7/00; B65D 83/0882

USPC ..... 83/614

See application file for complete search history.

(56) References Cited

U.S. PATENT DOCUMENTS

| | | | | |
|---|---|---|---|---|
| 5,275,321 | A * | 1/1994 | Manu | B65H 35/002 206/407 |
| 6,141,921 | A * | 11/2000 | Leeuwenburgh | E06B 3/285 428/214 |
| 7,000,520 | B2 * | 2/2006 | Nichols | B26D 1/045 225/47 |
| 8,479,626 | B1 * | 7/2013 | Winkler | B26D 1/205 220/23.2 |
| 2007/0044617 | A1 * | 3/2007 | Pavlik | B26D 1/045 83/614 |
| 2018/0305164 | A1 * | 10/2018 | Smith | B65H 35/0086 |

* cited by examiner

*Primary Examiner* — Kenneth E Peterson

(74) *Attorney, Agent, or Firm* — Gerald E. Hespos; Michael J. Porco; Matthew T. Hespos

(57) ABSTRACT

A window insulation apparatus includes a cylindrical core having opposite top and bottom ends. A plastic sheet has opposite top and bottom ends and is pleated along parallel fold lines that extend parallel to the top end of the sheet to form a folded sheet. Adhesive is applied adjacent the top end of the sheet. The folded sheet is wound around the cylindrical core so that the top end of the folded sheet is near the top end of the cylindrical core. A housing receives the core and the sheet wound on the core. The housing includes an elongate opening from which the sheet can be unwound. A cutting assembly is mounted to the housing substantially adjacent the elongate opening and can be moved parallel to the opening for cutting the sheet that has been dispensed from the opening.

8 Claims, 10 Drawing Sheets

WINDOW INSULATION APPARATUS AND METHOD

This application claims priority on U.S. Provisional Application No. 62/659,372 filed on Apr. 18, 2018, the entire disclosure of which is incorporated herein by reference.

BACKGROUND

Field of the Invention

The invention relates to an apparatus and method for insulating a window or patio door.

Description of the Related Art

Sheets of transparent plastic often are used to insulate windows and patio doors. In the most basic form, a large sheet simply is held against a window or the molding that surrounds the window and then is taped in place. The person who installs such a transparent plastic sheet typically is the homeowner. This person is not likely to be highly skilled and may not be accustomed to working on a ladder. Holding the sheet in the proper position and applying tape to secure the sheet can be difficult.

U.S. Pat. No. 6,141,921 discloses a sheet formed with an array of parallel folds or pleats so that the sheet is collapsed in a fan or accordion fashion. An adhesive is applied along an edge of the folded sheet that extends parallel to the fold lines. The folded sheet then is rolled about an axis that extends perpendicular to the folds. The worker begins at one corner by holding the adhesive edge against the upper horizontal strip of molding and then rolls the sheet laterally across the upper strip of molding. The worker then allows the sheet to fall gravitationally from the top edge that is adhered to the molding. The worker subsequently trims the sheet with a scissor vertically along the vertical strips of molding and horizontally along the lower strip of molding, or horizontally along the floor in the case of a patio door. The free edges of the sheet then are attached to the molding and/or to the floor using a separate role of adhesive tape. In some instances, a hairdryer is used to apply heat to the the transparent sheet of material. The heat of the hairdryer shrinks the sheet sufficiently to remove wrinkles.

The roles sheet of plastic material disclosed in U.S. Pat. No. 6,141,921 can be difficult to maneuver and manipulate as the sheet is being unrolled along the top horizontal strip of molding. More particularly, the rolled sheet often will elongate along the axis about which the sheet is rolled, thereby complicating efforts to apply the sheet to the window.

The subject invention was made in view of the above-described problems, and an object of the invention is to simplify the application of a transparent sheet of plastic material to a window or patio door for insulation.

SUMMARY OF THE INVENTION

The invention relates to an apparatus for insulating a window or patio door. The apparatus includes a sheet of transparent plastic material that is folded along a plurality of parallel fold lines to form pleats in the manner of a fan or an accordion. The folds are arranged so that a top folded panel has a top edge that projects beyond all other folded panels of the sheet. The extension of the top folded panel beyond other parts of the sheet may be about 1 inch. An adhesive is provided along one surface of this top folded panel adjacent to the extending edge of the top panel.

The apparatus further includes a cylindrical core having opposite top and bottom ends. The cylindrical core may have a hollow interior that extends between the top and bottom ends and may define an inside diameter of about one inch. The core may be formed from a paperboard material or plastic.

The folded sheet is wound about the cylindrical core so that the top edge of the top folded panel is near the top end of the cylindrical core and so that the adhesive faces in toward the axis of the core as the sheet is wound.

The apparatus further includes a housing that retains the core and the folded sheet that is wound about the core. The housing may be substantially tubular and may be substantially cylindrical. The housing has an inside cross-sectional dimension to accommodate the core and the folded sheet that is wound about the core. Additionally, the housing has a length greater than an axial length of the core and the folded sheet that is wound about the core.

The housing further includes first and second covers that are mounted respectively on opposite first and second ends of the housing. For example, the covers may be threaded into engagement with the housing. Each cover may include an axial projection that is dimensioned to fit into the core about which the folded sheet is wound. Thus, the covers and the housing effectively form a spool that permits rotation of the core about the axis of the core for permitting a controlled unwinding of the wound sheet as explained further herein.

The housing may further include a longitudinal opening extending parallel to the axis of the housing. The opening has a longitudinal length equal to or greater than an axial length of the folded sheet that is wound onto the core and/or withdrawn gradually from the housing at the opening as the sheet is unwound from the core.

The housing further includes a cutting assembly in proximity to the exterior of the housing and more particularly in proximity to the longitudinal opening in the housing. The cutting assembly may include a channel or rail that extends substantially parallel to the opening and substantially parallel to the axis of the core. More particularly, the housing may include a longitudinal rib projecting substantially radially out from the outer surface of the housing. The rib may form a radially aligned plane and may be parallel to the longitudinal opening in the housing. The channel or rail of the cutting assembly may be snapped or slid into secure engagement on the rib. For example, the channel or rail of the cutting assembly may include a groove dimensioned to engage over the rib and may be retained frictionally on the rib. Alternatively, the groove of the channel or rail of the cutting assembly may be secured adhesively on the rib. Other mounting arrangements may be provided as an alternate to the rib on the housing. For example, the housing may include openings that receive mounting projections of the channel or rail of the cutting assembly. The projections of the channel or rail of the cutting assembly may be configured to snap into engagement with the housing at in the mounting openings in the housing.

The channel or rail of the cutting assembly may further include a blade guide facing away from the housing and extending parallel to the axis of the housing. The blade guide may form a groove extending parallel to the axis of the housing and hence parallel to the axis of the core. The groove may have a substantially omega-shaped cross-section taken perpendicular to the extending direction of the groove. Thus, a width of the entry to the groove may be narrower than a maximum width of the groove. One end of the groove may be closed.

A blade carriage is mounted to the blade guide of the channel or rail of the cutting assembly. The blade carriage includes a base slidably engaged with the blade guide so that the blade carriage can move longitudinally along the blade guide. The base is larger than the narrow opening into the blade guide to keep the blade carriage from falling out of the blade guide. The blade carriage further includes an actuator facing away from the base and away from the housing when the blade carriage is mounted to the blade guide. A region of the blade carriage between the base and the actuator may be sufficiently narrow to slide in the narrow opening of the blade guide. The actuating surface may be configured to be engaged by a finger of a worker who is using the apparatus. For example, the actuating surface may be concave and may include a plurality of ribs that extend transverse to the longitudinal direction of the blade guide when the blade carriage is mounted to the blade guide. Other surface roughening or surface discontinuities may be provided instead of the transverse ribs.

The blade carriage further includes a cutting blade. The cutting blade may be mounted to the actuator and may face obliquely toward the base. Two oblique cutting edges may be provided so that the blade carriage can be moved in either direction for cutting. More particularly, the blade may be snapped into engagement in a groove in the blade carriage or may be secured by insert molding, adhesive or heat staking so that the cutting edge of the blade or blades face obliquely into the channel of the blade guide. With this arrangement, the sheet material can be placed on the blade guide and the blade carriage can be moved along the blade guide so that the cutting blade cuts through the sheet material.

The blade guide and/or the blade carriage preferably include means for preventing the blade carriage from being separated from the blade guide. For example, opposite longitudinal ends of the channel of the blade guide may be closed at least partly to stop longitudinal movement of the blade carriage on the blade guide before the blade carriage can be separated from the blade guide. Additionally, as explained further herein, the apparatus of this disclosure has a preferred gravitational orientation with a defined top end and a defined bottom end. The adhesive extending along the edge of the sheet material defines the top edge of the sheet material and is disposed to align with a top and of the housing. The blade carriage preferably is positioned releasably on the blade guide above the top edge of the folded and wound sheet material. Thus, the blade carriage will be releasably positioned so that a downward longitudinal movement of the blade carriage will cut through the sheet material dispensed from the housing. Accordingly, the channel or rail of the blade guide may include at least one projection, at least one recess or other surface discontinuity that can be engaged releasably by a mating structure on the blade carriage to hold the blade carriage and the blade at a position from which a cut can be commenced. The forces between the blade and the blade carriage and the blade guide should be sufficient to prevent a gravitational movement of the blade carriage, while permitting relatively easy movement in response to digital pressure exerted by a worker.

The housing of the apparatus may further include a tape receptacle. The tape receptacle may be at one longitudinal end of the housing and may be dimensioned for receiving at least one and preferably two rolls of adhesive tape. The roll of adhesive tape can be accessed by unthreading the cover that covers the tape receptacle.

The apparatus of the invention can be used by holding the housing with the axes of the core and the housing aligned substantially vertically and with the top end of the housing facing up. Additionally, the top edge of the rolled sheet should substantially align with the top molding of a window or patio door. The worker then dispenses the rolled sheet material from the housing while pressing the adhesive along the top edge of the sheet material into contact with the molding above the window or patio door. This dispensing of the sheet material is carried out merely by moving the housing laterally with one hand while pressing the top edge of the sheet against the molding with the other hand. Upon reaching the opposite side edge of the top molding of the window or patio door, the worker simply cuts the sheet vertically. This cutting is carried out safely and easily merely by exerting digital pressure on the blade carriage and displacing the blade carriage down relative to the housing and the window or patio doorway. The worker then simply allows the folded sheet material to cascade gradually down across the window or patio door. The worker then removes the cover from the housing and accesses the tape stored in the end of the tape receptacle of the housing. The worker then uses the tape to secure side edges of the sheet to the vertical strips of molding along opposite sides of the window or patio doorway. Remaining plastic in the tubular housing can be used in a similar manner on another window or patio doorway.

DETAILED DESCRIPTION

Figure 1:
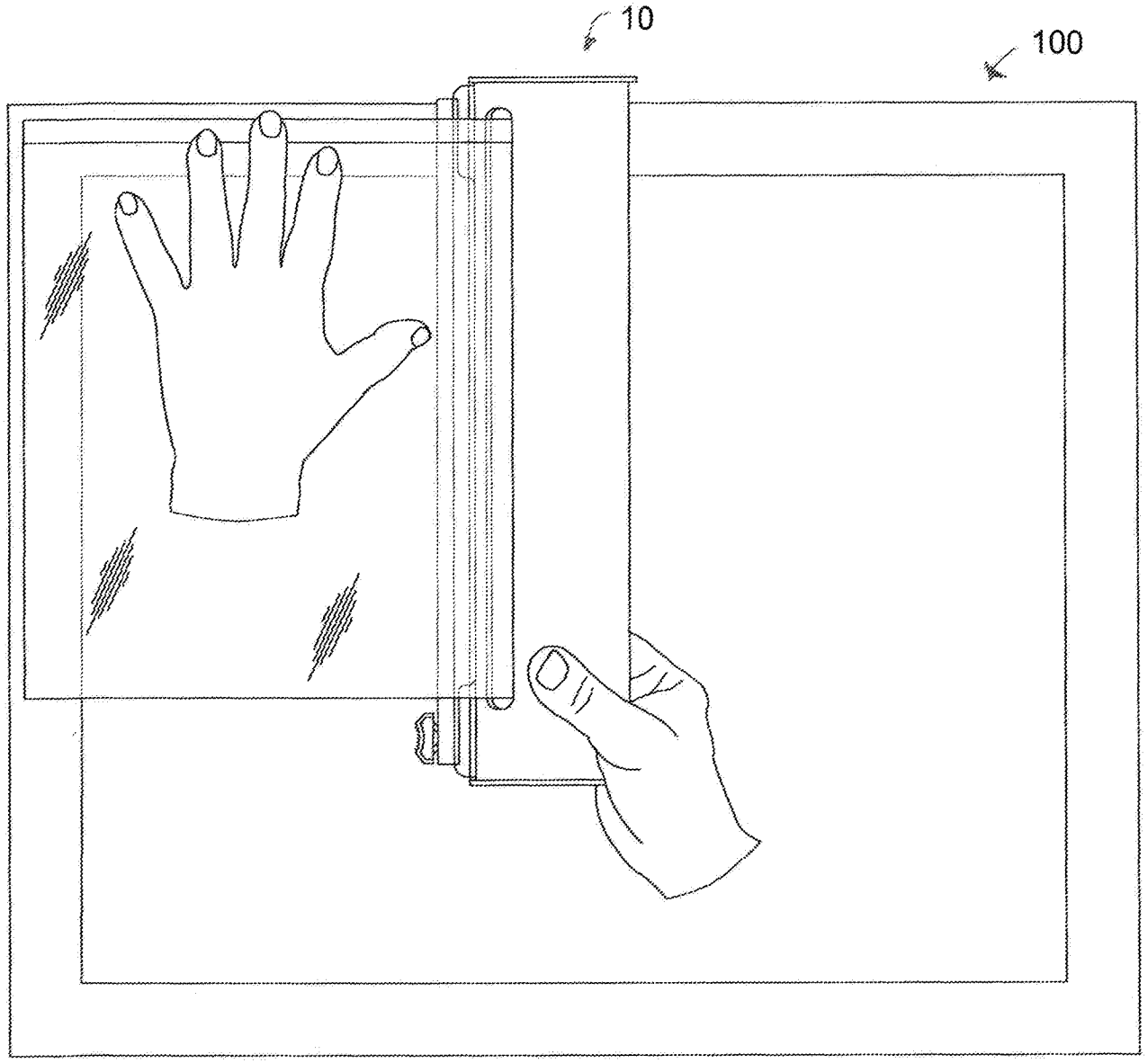
FIG. 1 is a front elevational view of an apparatus for installing window insulation in accordance with an embodiment of the invention and shown during an installation procedure.
Figure 2:
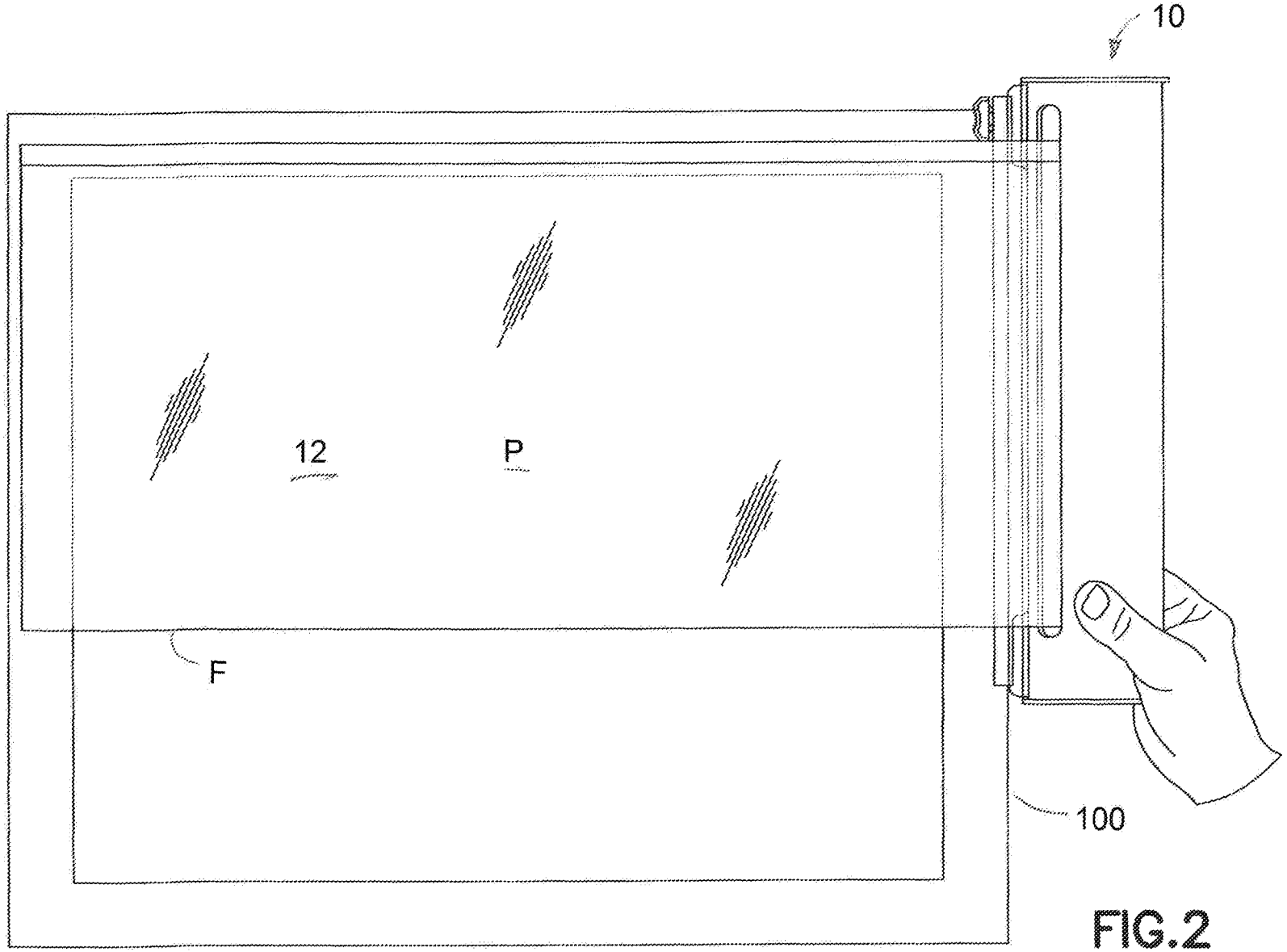
FIG. 2 is a front elevational view of the apparatus of FIG. 1 near the end of an installation procedure.
Figure 3:
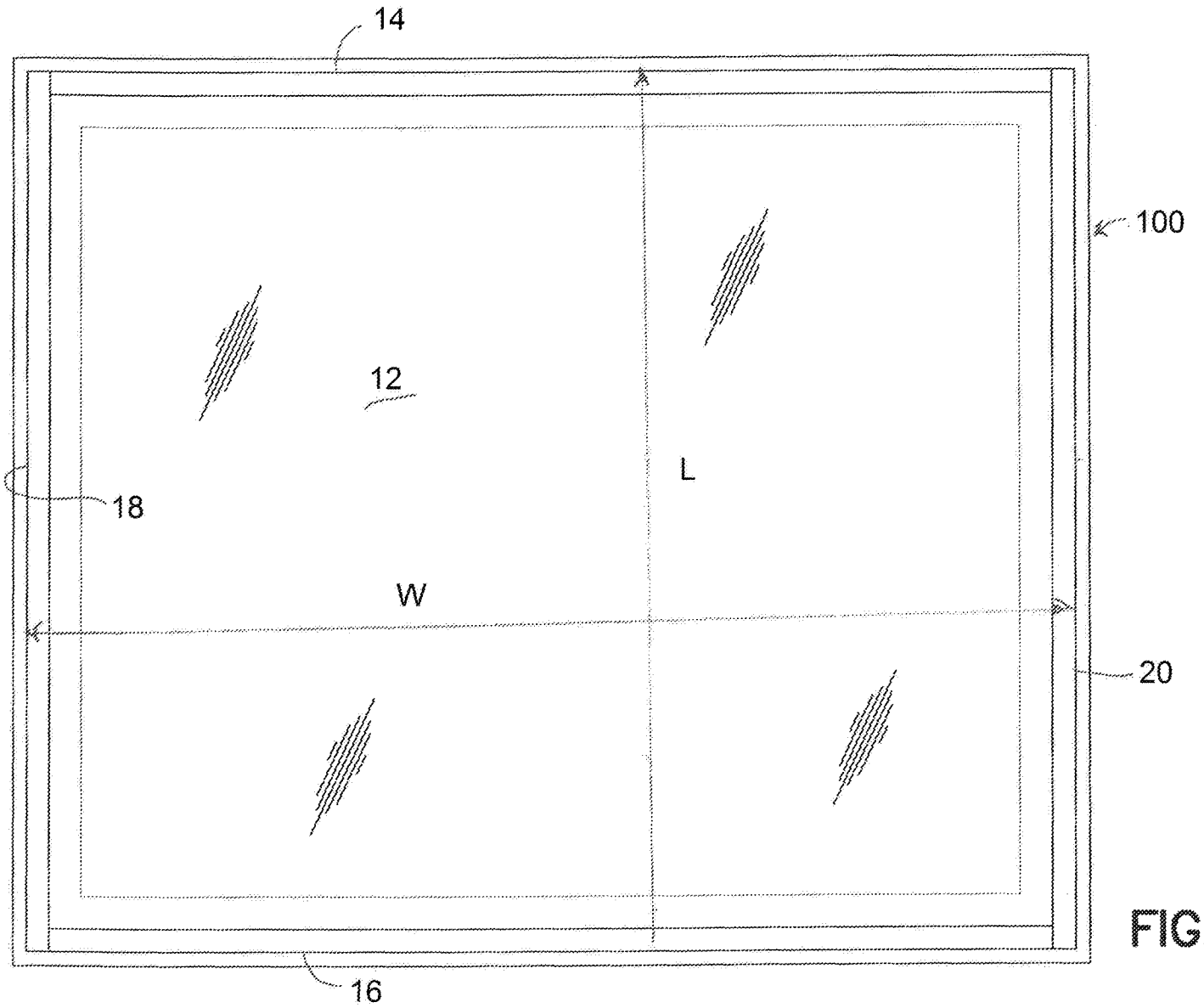
FIG. 3 is a front elevational view of the sheet of insulation on a window after complete installation.
Figure 4:
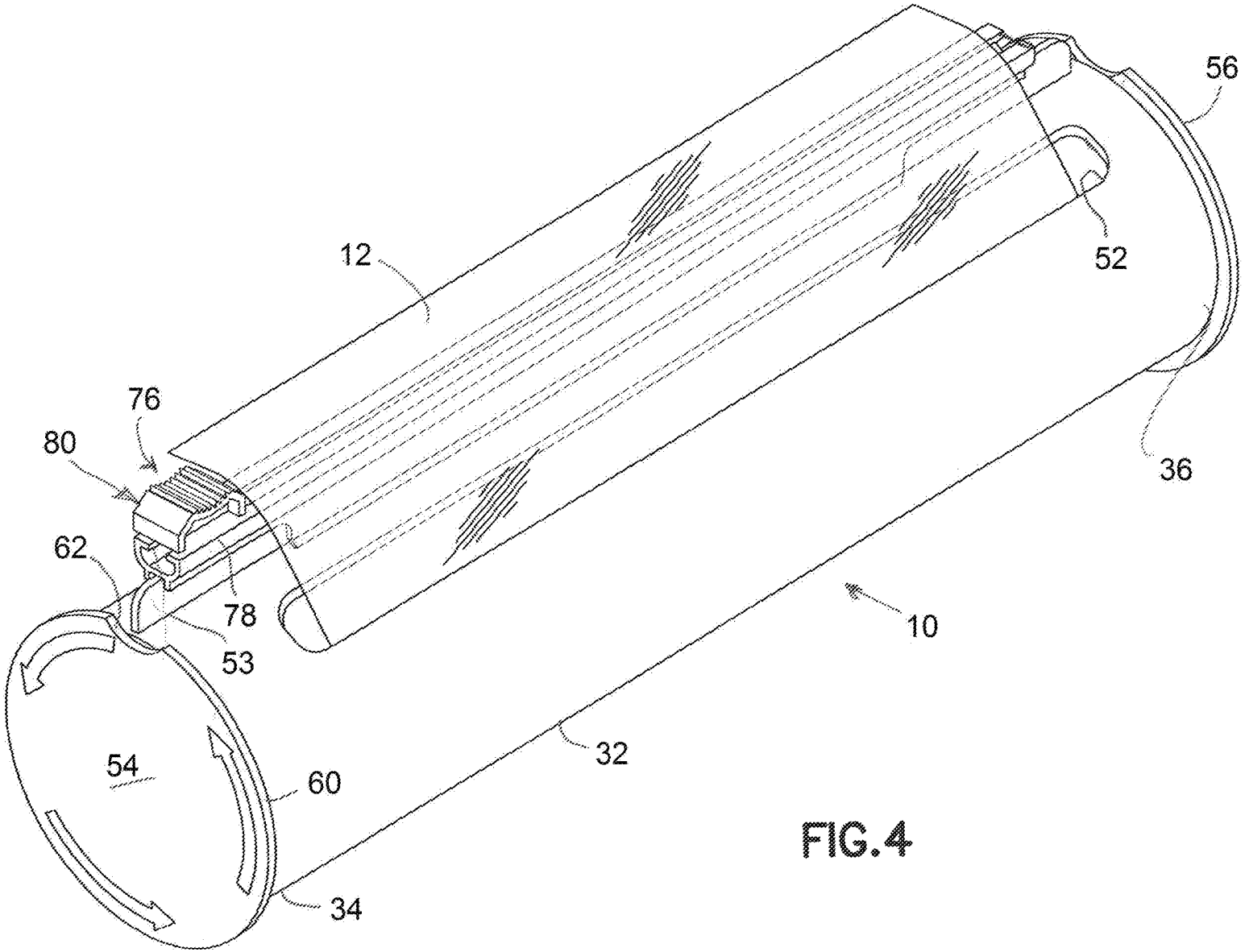
FIG. 4 is a perspective view of the apparatus for installing window insulation as purchased by a consumer.
Figure 5:
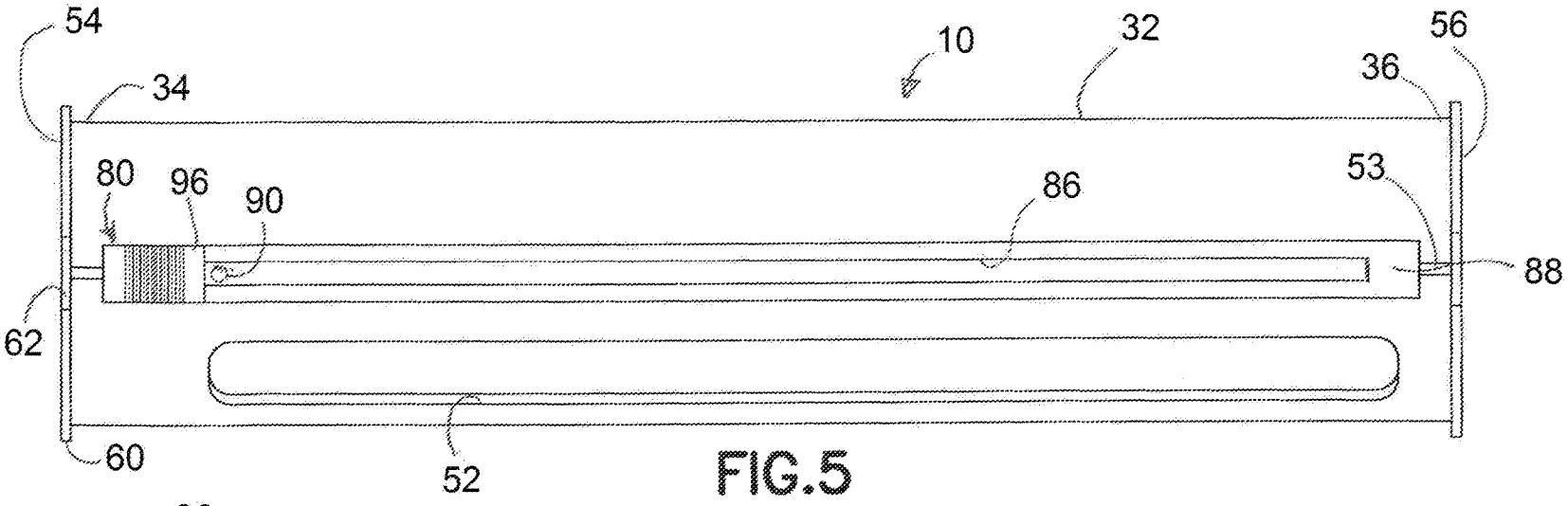
FIG. 5 is a top plan view of the apparatus shown in FIG. 4.
Figure 6:
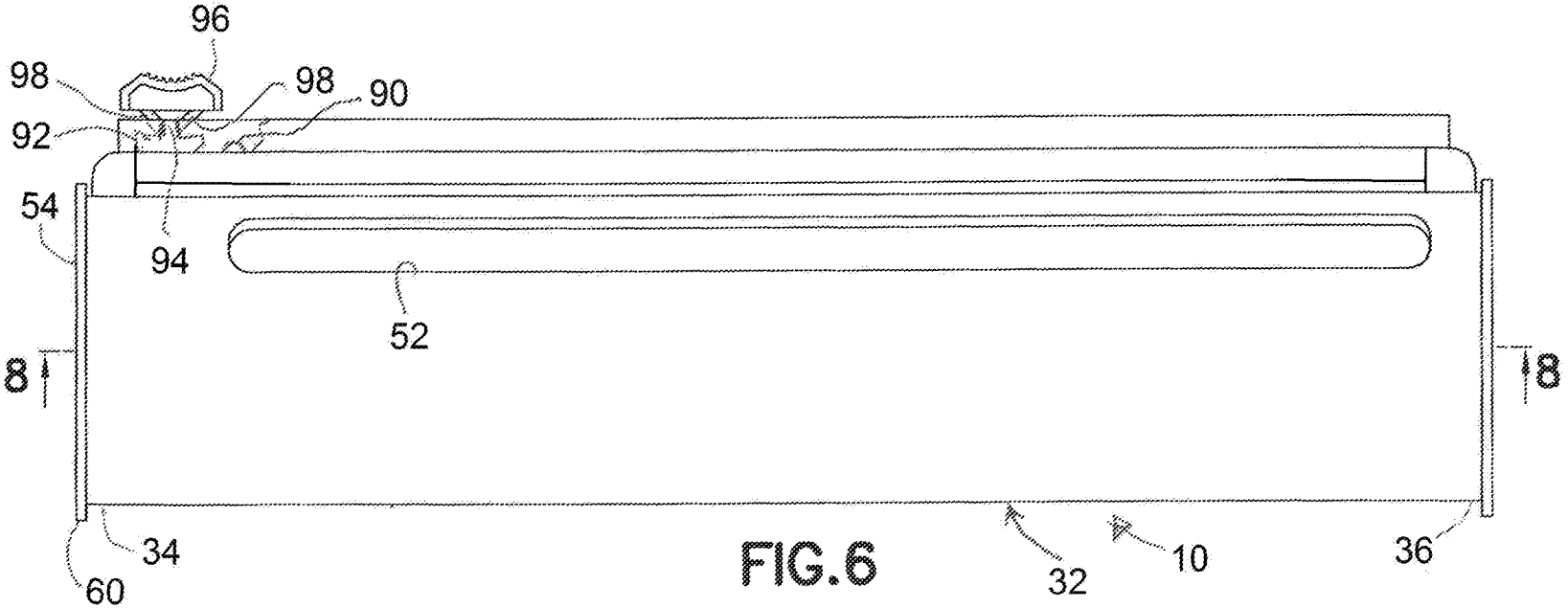
FIG. 6 is a side elevational view of the apparatus of FIGS. 4 and 5.
Figure 7:
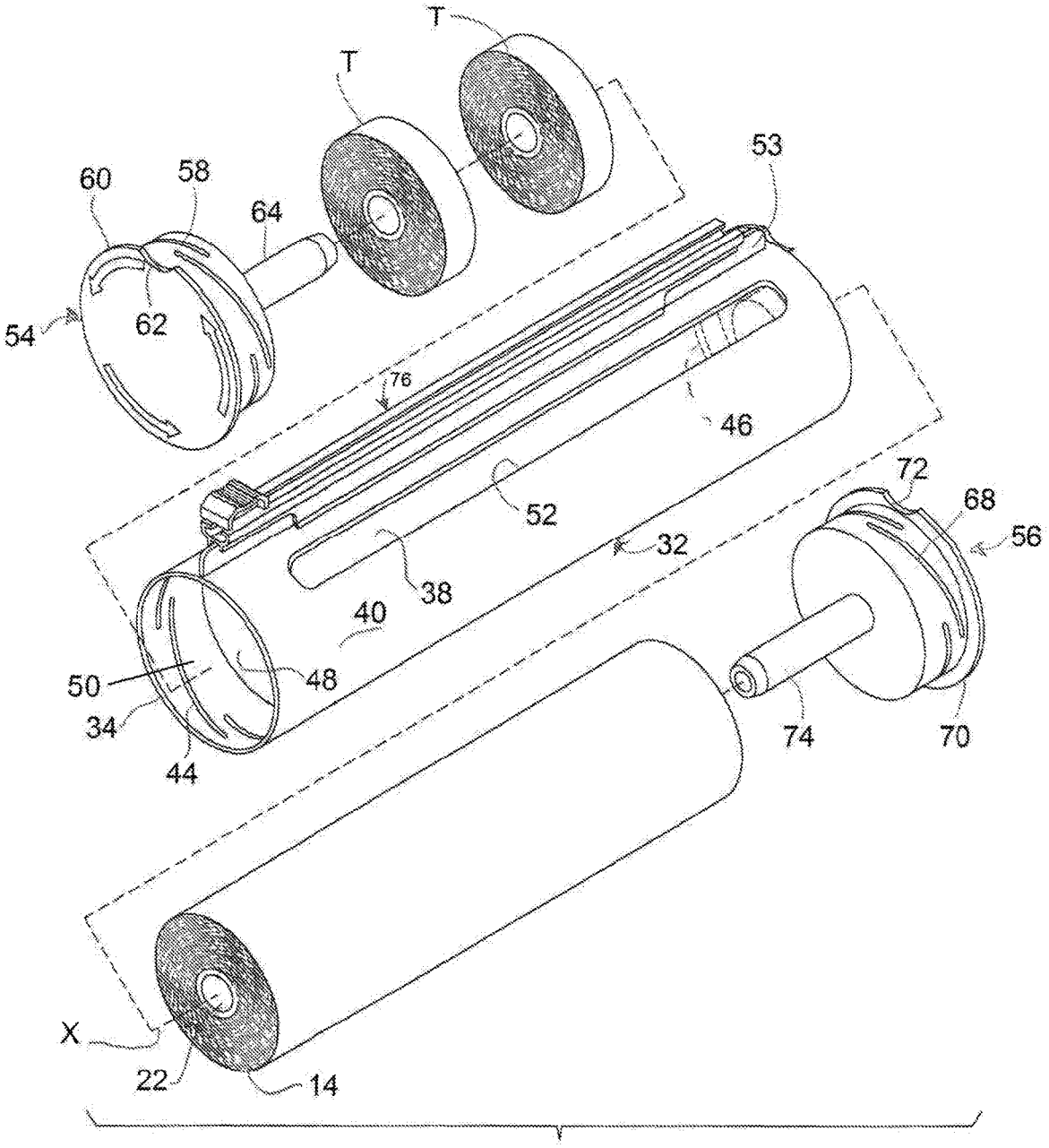
FIG. 7 is an exploded perspective view of the apparatus shown in FIGS. 4-6.

FIGS. 1-3 generally illustrate an apparatus 10 for insulating a window 100 or patio door. The apparatus 10 includes a rectangular sheet of transparent plastic material 12 having opposite top and bottom edges 14 and 16 defining a length L and opposite left and right side edges 18 and 20 defining a with W, as shown in FIG. 3. The sheet 12 is folded along a plurality of parallel folds F extending parallel to the width W to form panels P pleats in the manner of a fan or an accordion, as shown in FIGS. 12-15. The folds F are arranged so that the top edge 14 projects beyond all other folded panels P of the sheet 12. The extension of the top edge 14 panel beyond other parts of the folded sheet 12 may be about 1 inch. An adhesive 21 is provided along one surface of this top folded panel P adjacent to the extending top edge 14 of the top panel P.

Figure 8:
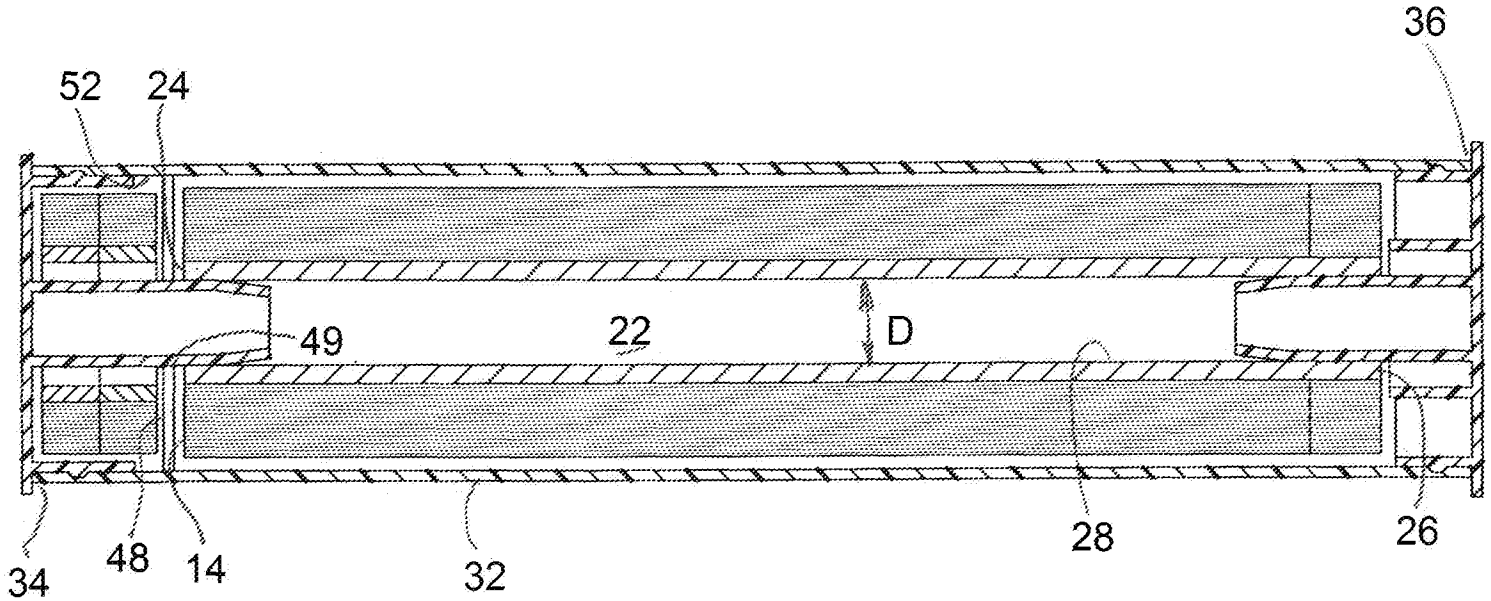
FIG. 8 is a longitudinal cross-sectional view of the apparatus shown in FIGS. 4-7.
Figure 9:
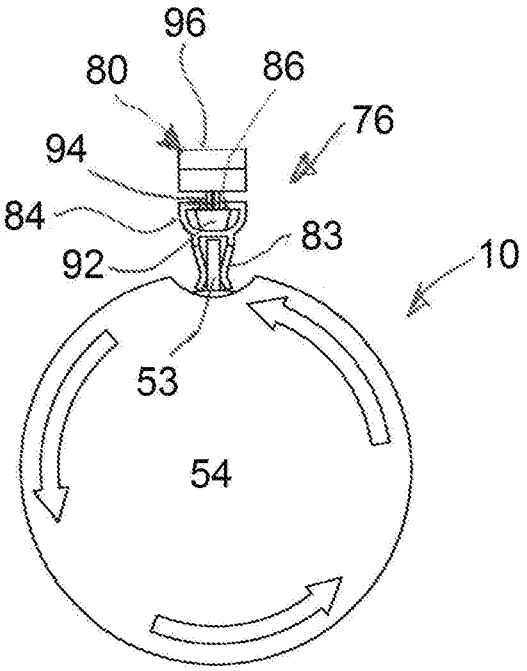
FIG. 9 is an end elevational view of the apparatus shown in FIGS. 4-8.
Figure 12:
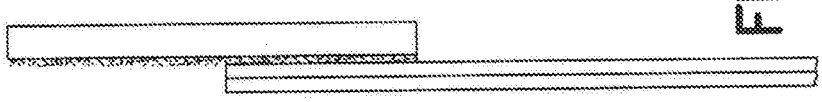
FIG. 12 is an enlarged side elevational view of the top area of the sheeting shown in FIG. 11.
Figure 11:
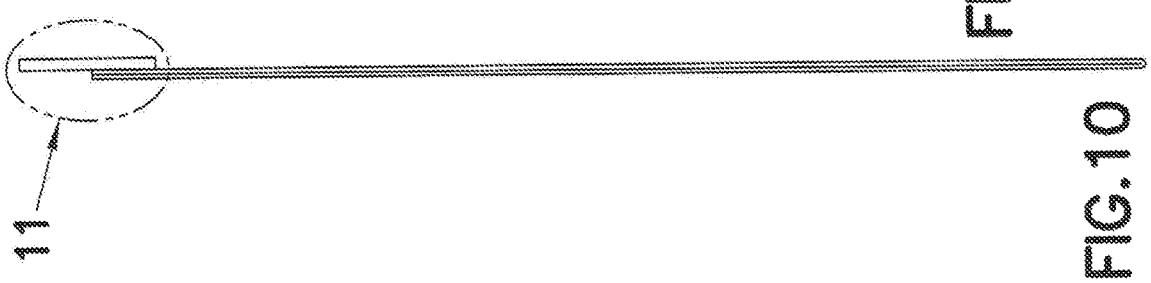
FIG. 11 is a side elevational view of the sheeting of FIG. 10
Figure 10:
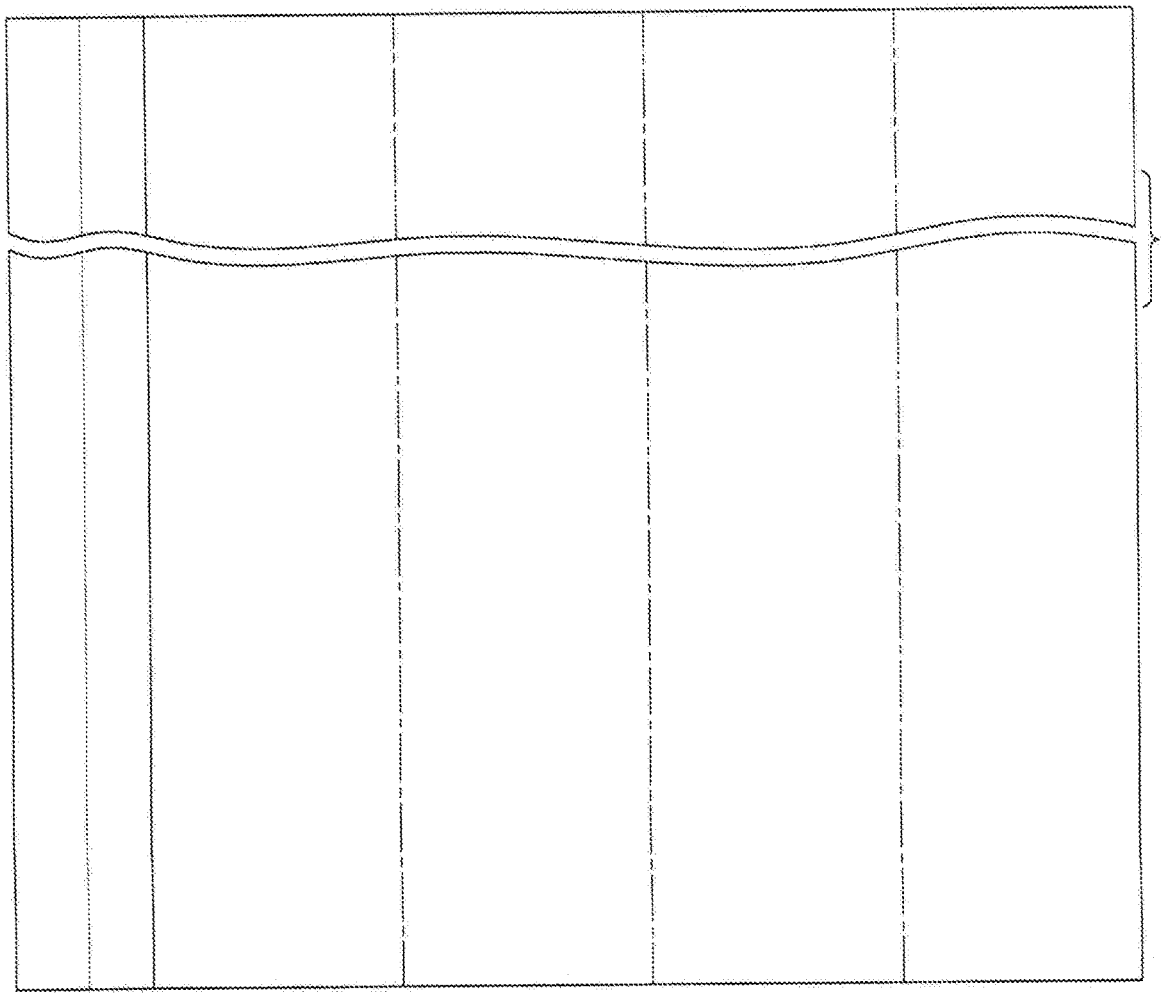
FIG. 10 is a front elevational view of the plastic sheeting with an adhesive applied to a top edge thereof.
Figure 13:
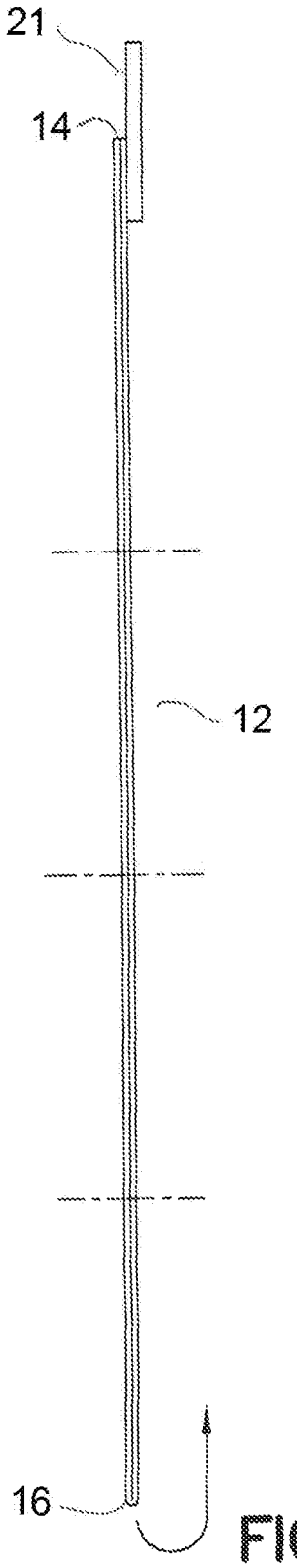
FIGS. 13-16 are side elevations view showing successive steps in folding the sheeting prior to winding on the core.
Figure 14:
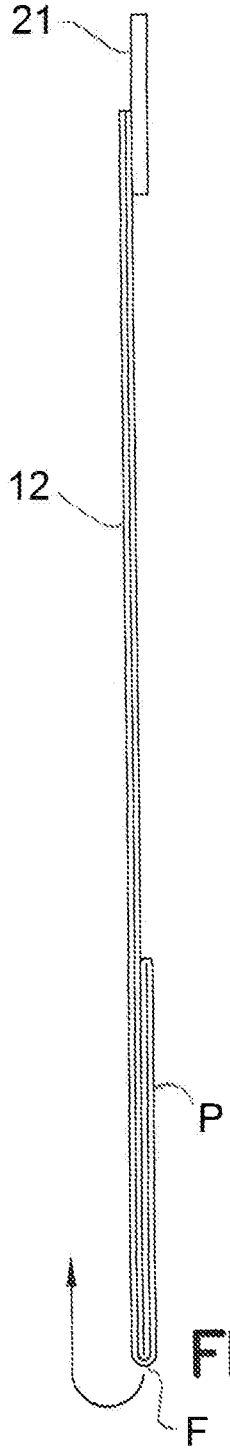

The apparatus further includes a hollow cylindrical core 22 having opposite top and bottom ends 24 and 26, as shown most clearly in FIG. 8. Thus, the cylindrical core 22 a hollow interior 28 that extends between the top and bottom ends 24 and 26 and may define an inside diameter D of about 1 inch. The core 22 may be formed from a paperboard material or plastic.

Figure 15:
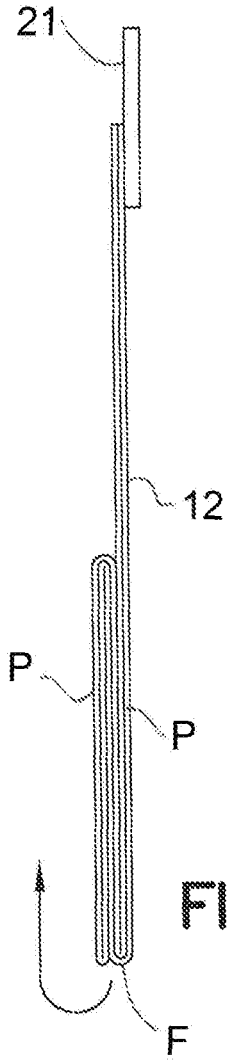
Figure 16:
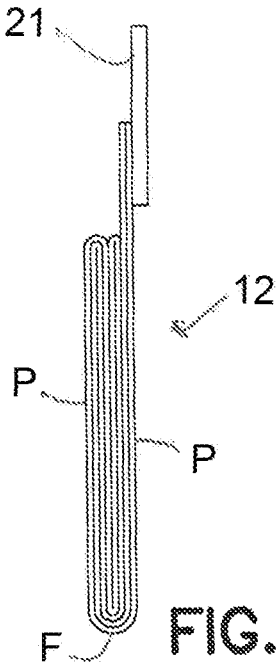

The folded sheet 12 shown in FIGS. 2 and 15 is wound about the cylindrical core 22 so that the top edge 14 of the folded panel P is aligned with the top end 24 of the cylindrical core 22 and so that the adhesive 21 faces in toward the axis X of the core 22 as the sheet 12 is wound around the core 22.

The apparatus 10 further includes a substantially cylindrical housing 32 with opposite top and bottom ends 34 and 36. The cylindrical housing 32 includes opposite inner and outer circumferential surface 38 and 40. A first array of internal threads 44 is disposed in proximity to the top end 34 of the housing 32 and a second array of internal threads 46 is disposed in proximity to the bottom end 44. A transverse wall 48 extends across the inner circumferential surface 38 at a position near the upper and 34 of the housing 32. The transverse wall 48 includes a circular central opening 49 within inside diameter substantially equal to the inside diameter D of the core 22. An axially short receptacle 50 is defined between the transverse wall 48 and the first end 34 of the housing 32. An elongate opening 52 extends through the housing 32 from an upper position near the transverse wall 48 to a lower position near the bottom end 36 of the housing 32. A mounting rib 53 projects radially out from the housing 32 and extends substantially from the top end 34 to the bottom and 36 of the housing 32.

The apparatus 10 further includes top and bottom covers 54 and 56 mounted respectively to the top and bottom ends 34 and 36 of the housing 32. The top cover 54 includes an array of external threads 58 that are dimensioned to engage the internal threads 44 adjacent the top end 34 of the housing 32. A top flange 60 projects radially out on the top cover 54 and will engage against the top end 34 of the housing 32 to limit insertion of the top cover 54 into the top end 34 of the housing 32. The top flange 60 has a gripping recess 62 to facilitate manipulation of the top cover 54. The top cover 54 further includes a top spindle 64 with an outside diameter dimensioned to be telescoped through the central opening 49 in the transverse wall 48 and into the interior of the core 22 at a position near the top end 24 of the core 22.

The bottom cover 56 includes an array of external threads 68 that are dimensioned to engage the internal threads 46 adjacent the bottom end 36 of the housing 32. A bottom flange 70 projects radially out on the bottom cover 56 and will engage against the bottom end 36 of the housing 32 to limit insertion of the bottom cover 56 into the bottom end 36 of the housing 32. The bottom flange 70 has a gripping recess 72 to facilitate manipulation of the bottom cover 56. The bottom cover 56 further includes a bottom spindle 74 with an outside diameter dimensioned to be telescoped into the interior of the core 22 at a position near the bottom end 26 of the core 22.

The apparatus 10 further includes a cutting assembly 76 in proximity to the exterior of the housing 32 and more particularly in proximity to the mounting rib 53 and the elongate opening 54 in the housing 32. The cutting assembly 76 includes a rail 78 and a blade carriage 80 that is configured to move linearly along the rail 78. The rail 78 includes a mounting groove 83 that is configured to be mounted on the mounting rib 53 of the housing 32. The rail 78 and the mounting groove 83 extend substantially the entire length of the mounting rib 53 on the housing 32. More particularly, the rail 78 may be held in position on the mounting rib 53 by a frictional fit between the mounting groove 83 and the mounting rib 53, or by adhesive, or by snap fit structures or by other known mechanical arrangements for holding elongate parts in proximity to one another. The rail 78 further includes a blade guide 84 that is configured to accommodate limited sliding linear movement of the blade carriage 80 along the rail 78. More particularly, the blade guide 84 is an elongate channel that extends parallel to the elongate opening 54 in the housing 32 and that faces away from the housing 32 when the mounting groove 83 is engaged on the mounting rib 53 of the housing 32. The channel formed by the blade guide 84 is of substantially omega-shaped cross-section so that a longitudinally extending opening 86 into the channel of the blade guide 84 is narrower than an internal width of the channel at more central positions in the blade guide 84. The longitudinally extending opening 86 in the blade guide 84 does not extend continuously to the opposite ends of the blade guide 84. Rather, at least one end of the blade guide 84 has a stop 88 that closes the longitudinally extending opening 86 to prevent or impede separation of the blade carriage 80 from the rail 78. The stop need not be a continuous wall as shown in the illustrated embodiments. Rather, projections or detents can be provided to impede removal of the blade carriage 80 from the rail 78. The rail 78 further includes a projection 90 on at least one end of the rail for releasably holding the blade carriage 80 near the end of the rail 78. In this regard, the projection 90 may be rounded and may be disposed in proximity to the end of the rail 78 that will be near the top end of the housing 32. Thus, the blade carriage 80 is impeded from sliding gravitationally down when the axis X of the housing 32 is aligned vertically and with the top end 34 of the housing 32 above the bottom and 36. However, a slight manual force on the blade carriage 80 will permit the blade carriage 80 to be slid longitudinally along the rail 78.

The blade carriage 80 includes a base 92, a support 94 and an actuator 96. The base 92 is dimensioned to be slid longitudinally through the blade guide 84. However, the base 92 is wider than the longitudinally extending opening 86 in the blade guide 84 so that the base 92 of the blade carriage 80 is retained in the blade guide 84. The support 94 is narrower than the longitudinally extending opening 86 in the blade guide and projects from the base through the longitudinally extending opening 86 in the blade guide 84. The actuator 96 is wider than the support 94 and is configured to receive digital pressure from a worker or sliding the blade carriage 80 along the blade guide 84. For example, a surface of the actuator 96 facing away from the housing 32 may be concave and may be formed with transverse ribs or other surface irregularities to facilitate pushing forces on the actuator 96.

The blade carriage 80 further includes at least one blade 98 mounted to a side of the actuator 96 facing toward the base 92. The blade has at least one cutting edge that preferably bases obliquely toward the blade guide 84. In a preferred embodiment, two cutting edges face generally oppositely from one another with each being aligned at an acute angle to the blade guide.

The apparatus 10 further includes two rolls of tape T mounted in the receptacle 50 in the top end 34 of the housing 32. Each roll of tape T includes a core with an opening that can receive the top spindle 64 of the top cover 54.

The apparatus is used by holding the housing 32 with the axis X aligned vertically and with the top end 34 above the bottom and 36. More particularly, the housing 32 is positioned near the top of the window 100 to which the sheeting 12 will be applied. The sheeting 12 is pulled slightly out from the opening 54 in the housing 32 and the worker presses the adhesive 22 against the upper strip of molding on the window 100. The housing 32 is moved horizontally across the upper strip of molding of the window 100 while holding the housing 32 in one hand and pressing the adhesive 32 against the molding with the other hand. When the housing has been move the entire width of the window 100, the worker merely exerts digital pressure on the actuator 96 of the blade carriage 80 to move the blade carriage 80 down along the blade guide 84. This movement will cause the blade 98 to cut through the plastic sheeting 12. The housing 32 with the cutting assembly 76 retained thereon is moved away from the window 100. The adhesive 22 will retain the sheeting 12 suspended from the upper strip of molding on the window 100. The worker then simply allow us the plastic sheeting to unfold gravitationally and into a position covering the glass of the window 100. The worker then unscrewed the top cover 54 from the housing 32 and removes the rolls tape T. The tape is used to secure the side edges of the sheeting 12 to the vertical side strips of molding on the window 100. The user then can use a scissor to trim the bottom of the sheeting to align with the lower strip of molding on the window 100. Tape T can be used to secure the trimmed lower edge of the sheeting to the lower strip of molding on the window 100. The worker optionally then can use a hairdryer to heat the sheeting sufficiently to shrink and define a tight plane across the window.

The invention has been described with respect to a preferred embodiment. However, changes can be made without departing from the scope of the invention.

For example, the housing can include a handle projecting axially from the bottom end of the housing to facilitate gripping of the housing 32. Alternatively, a U-shaped handle can be mounted to top and bottom regions of the housing so that a grip is disposed approximately centrally between the top and bottom ends of the housing but at a positions spaced radially out from the housing.

The spindles 64 and 74 of the covers are illustrated as being substantially cylindrical. However, a cylindrical spindle is not required provided that the core 22 can be rotated relative to the spindles 64 and 74.

The amount of sheeting 12 that is wound onto the core 22 can be varied widely depending upon the sizes of the windows or patio doors for which the apparatus is intended. Additionally, the amount of sheeting 12 can be selected to cover several windows.

The housing 32 can be reusable and new roles of tape can be mounted therein merely by removing one or both covers 60 or 70.

What is claimed is:

1. A window insulation apparatus comprising:

a cylindrical core having opposite top and bottom ends and opposite inner and outer cylindrical surfaces extending between the ends;

a plastic sheet having opposite top and bottom ends, the plastic sheet being pleated along parallel fold lines that extend parallel to the top end of the sheet to form a folded sheet, an adhesive being applied along one surface of the plastic sheet adjacent the top end of the sheet, the folded sheet being wound around the outer cylindrical surface of the cylindrical core so that the top end of the folded sheet is in proximity to the top end of the cylindrical core;

housing having opposed top and bottom ends spaced from each other in an axial direction and an outer surface, the cylindrical core and the plastic sheet wound around the cylindrical core received in the housing so that the top end of the plastic sheet is in proximity to the top end of the housing, the housing having an elongate opening extending in the axial direction and dimensioned to permit the plastic sheet to be dispensed from the housing, a mounting rib projecting out from the outer surface in a direction normal to the axial direction and extending in the axial direction of the housing so as to be parallel to the elongate opening; and a cutting assembly having a rail with a mounting groove engaged on the mounting rib of the housing, the rail further having a blade guide on a side of the rail opposite the mounting groove and extending parallel to the elongate opening in the housing, the cutting assembly further having a blade carriage movably mounted along the blade guide, the blade carriage having at least one blade facing at least partly toward the housing and configured for cutting the plastic sheet positioned between the blade and the blade guide by moving the blade carriage along the blade guide, wherein the blade guide and the blade carriage have interengaging structures configured for releasably holding the blade carriage at a position on the blade guide between the top end of the plastic sheet and the top end of housing for preventing the blade carriage from sliding gravitationally down along the blade guide at least one roll of adhesive tape removably positioned in the housing, a cover removably engaged with the housing and configured for closing the receptacle, wherein the cover includes a spindle that engages in a core of the roll of adhesive tape and in the cylindrical core of the plastic sheet, so that the cylindrical core and the roll of adhesive tape are aligned axially.

2. The apparatus of claim 1 wherein the cover is threadedly engaged with one longitudinal end of the housing.

3. The apparatus of claim 2, wherein the cover is a top cover that is mounted on the top end of the housing, and wherein the apparatus further includes a bottom cover removably mounted to the bottom end of the housing.

4. The apparatus of claim 2 wherein the cover includes a flange projecting out beyond an outer periphery of the housing, the flange including at least one recess to facilitate gripping of the cover.

5. The apparatus of claim 1, wherein the blade guide includes a channel with a longitudinal opening, the blade carriage including a support slidably engaged in the longitudinal opening in the blade guide, and an actuator mounted on the support at a position external of the blade guide.

6. The apparatus of claim 1, wherein the rail has opposite top and bottom ends, the mounting groove having a top end spaced from the top end of the rail.

7. The apparatus of claim 6, wherein the interengaging structures on the blade guide and the blade carriage include an interengaging structure on the blade guide between the top end of the mounting groove and the top end of the rail.

8. The apparatus of claim 7, wherein the interengaging structures on the blade guide and the blade carriage include a projection in the blade guide of the rail.

* * * * *